US009188414B2

(12) United States Patent
Burczynski

(10) Patent No.: US 9,188,414 B2
(45) Date of Patent: Nov. 17, 2015

(54) REDUCED FRICTION EXPANDING BULLET WITH IMPROVED CORE RETENTION FEATURE AND METHOD OF MANUFACTURING THE BULLET

(71) Applicant: RA Brands, L.L.C., Madison, NC (US)

(72) Inventor: Thomas J. Burczynski, Montour Falls, NY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 13/768,424

(22) Filed: Feb. 15, 2013

(65) Prior Publication Data

US 2014/0230683 A1 Aug. 21, 2014

(51) Int. Cl.
*F42B 12/34* (2006.01)
*F42B 12/78* (2006.01)

(52) U.S. Cl.
CPC ..... *F42B 12/34* (2013.01); *F42B 12/78* (2013.01)

(58) Field of Classification Search
CPC ..... F42B 12/31; F42B 12/76; F42B 12/78
USPC ..... 102/501, 507, 508, 509, 510, 514, 516, 102/517; 86/54, 55
See application file for complete search history.

(56) References Cited

U.S. PATENT DOCUMENTS 1,081,616 A * 12/1913 Johnson ..... 102/507
1,681,295 A * 8/1928 Johnson ..... 102/509
1,892,158 A 12/1932 Matthews (Continued)

FOREIGN PATENT DOCUMENTS

DE 648039 C 7/1937
DE 705504 C 4/1941

(Continued)

OTHER PUBLICATIONS

International Search Report dated Oct. 7, 2014 for PCT/US2014/015672 filed Feb. 11, 2014.

(Continued)

*Primary Examiner* — James S Bergin
(74) *Attorney, Agent, or Firm* — Womble Carlyle Sandridge & Rice, LLP

(57) ABSTRACT

A low-cost, reduced friction expanding bullet with an improved core retention feature and a method of manufacturing the bullet is described wherein a cylindrical jacket containing a compacted malleable metal core having an open end and a closed end is forced into a forming die having a bottleneck shaped interior resulting in a bottleneck shaped pre-form wherein the outside diameter of the open-ended forward portion of the jacket is smaller than the outside diameter of its closed rearward portion and wherein a transition shoulder separates the two diameters. The pre-form is then placed in a profile die wherein a base punch exerts an axial force against said pre-form which axially collapses a portion of the jacket wall forward of the transition shoulder subsequently forcing said portion of the jacket wall radially inwardly providing a reduction in bearing surface and forming an internal core-locking radius while at the same time forming an ogival bullet nose. The bullet thus formed provides reduced friction and ultimately higher muzzle velocity per any given chamber pressure level while also providing a core-locking feature comprising a wide-area, circumferential indentation which serves as a living hinge that ultimately expedites uniform bullet expansion.

19 Claims, 6 Drawing Sheets

(56) References Cited

U.S. PATENT DOCUMENTS

| | | | | | |
|---|---|---|---|---|---|
| 2,045,964 | A | * | 6/1936 | Otto | 102/509 |
| 2,322,751 | A | | 6/1943 | Studler | |
| 2,333,091 | A | * | 11/1943 | Crasnoff | 102/507 |
| 2,696,130 | A | | 12/1954 | Peters | |
| 3,142,256 | A | * | 7/1964 | Mack | 102/514 |
| 3,143,966 | A | | 8/1964 | Burns, Jr. et al. | |
| 3,157,137 | A | * | 11/1964 | Burns, Jr. | 102/509 |
| 3,311,962 | A | | 4/1967 | Burns, Jr. | |
| 3,349,711 | A | | 10/1967 | Darigo et al. | |
| 3,431,612 | A | * | 3/1969 | Darigo Julius et al. | 86/55 |
| 3,881,421 | A | | 5/1975 | Burczynski | |
| 4,108,073 | A | | 8/1978 | Davis | |
| 4,336,756 | A | | 6/1982 | Schreiber | |
| 4,352,225 | A | | 10/1982 | Schreiber | |
| 4,517,897 | A | | 5/1985 | Kneubuhl | |
| 4,550,662 | A | | 11/1985 | Burczynski | |
| 4,610,061 | A | * | 9/1986 | Halverson | 86/55 |
| 4,660,263 | A | | 4/1987 | Kosteck | |
| 4,776,279 | A | | 10/1988 | Pejsa | |
| 4,793,037 | A | | 12/1988 | Carter | |
| 4,856,160 | A | | 8/1989 | Habbe et al. | |
| 4,878,434 | A | | 11/1989 | Sommet | |
| 4,947,755 | A | | 8/1990 | Burczynski | |
| 5,079,814 | A | * | 1/1992 | Moore et al. | 86/55 |
| 5,101,732 | A | * | 4/1992 | Schluckebier | 102/509 |
| 5,160,805 | A | | 11/1992 | Winter | |
| 5,357,866 | A | | 10/1994 | Schluckebier et al. | |
| 5,385,100 | A | * | 1/1995 | Corzine et al. | 102/507 |
| 5,385,101 | A | | 1/1995 | Corzine et al. | |
| 5,535,495 | A | | 7/1996 | Gutowski | |
| D389,221 | S | | 1/1998 | Borg | |
| 5,943,749 | A | | 8/1999 | Swank | |
| 6,182,574 | B1 | * | 2/2001 | Giannoni | 102/516 |
| 6,213,022 | B1 | | 4/2001 | Pullum | |
| 6,244,187 | B1 | | 6/2001 | Head | |
| D447,209 | S | | 8/2001 | Benini | |
| 6,530,328 | B2 | | 3/2003 | Burczynski et al. | |
| 6,600,126 | B2 | | 7/2003 | Steinhoff et al. | |
| 6,776,101 | B1 | | 8/2004 | Pickard | |
| 6,805,057 | B2 | * | 10/2004 | Carr et al. | 102/509 |
| 7,143,679 | B2 | | 12/2006 | Yaich | |
| 7,210,411 | B2 | | 5/2007 | Booth et al. | |
| 7,322,297 | B2 | | 1/2008 | Yaich | |
| 7,380,502 | B2 | | 6/2008 | Emary | |
| 7,543,535 | B2 | * | 6/2009 | Herrlinger | 102/514 |
| 7,748,325 | B2 | | 7/2010 | Marx | |
| D621,468 | S | | 8/2010 | Nilsson | |
| 7,854,083 | B1 | | 12/2010 | Aalto | |
| 7,874,253 | B2 | | 1/2011 | Marx | |
| 7,891,298 | B2 | | 2/2011 | Minick et al. | |
| 7,908,780 | B2 | | 3/2011 | Fitzpatrick et al. | |
| D646,179 | S | | 10/2011 | Jansen | |
| 8,042,297 | B2 | | 10/2011 | Emde | |
| 8,061,255 | B1 | | 11/2011 | Boberg | |
| 8,117,967 | B2 | | 2/2012 | Salvel | |
| 8,141,494 | B2 | * | 3/2012 | Riess et al. | 102/516 |
| 8,161,885 | B1 | | 4/2012 | Emary | |
| D664,042 | S | | 7/2012 | Kurpis | |
| 8,256,352 | B2 | | 9/2012 | Masinelli | |
| 8,397,641 | B1 | | 3/2013 | Jackson | |
| 8,448,575 | B2 | | 5/2013 | Goddard | |
| 8,511,233 | B2 | | 8/2013 | Nilsson | |
| 8,640,589 | B2 | | 2/2014 | Dryer et al. | |
| 8,646,389 | B2 | | 2/2014 | Masinelli | |
| 8,752,484 | B2 | * | 6/2014 | Burczynski | 102/439 |
| 8,763,535 | B2 | | 7/2014 | Padgett | |
| 8,789,470 | B2 | | 7/2014 | Frank | |
| 8,950,333 | B2 | * | 2/2015 | Burczynski et al. | 102/507 |
| 9,046,333 | B2 | * | 6/2015 | Masinelli | 1/1 |
| 2005/0183617 | A1 | | 8/2005 | MacDougall | |
| 2006/0027128 | A1 | | 2/2006 | Hober | |
| 2006/0027132 | A1 | | 2/2006 | Libra | |
| 2010/0224093 | A1 | | 9/2010 | Wilhelm et al. | |
| 2011/0179965 | A1 | | 7/2011 | Mason | |
| 2012/0067245 | A1 | * | 3/2012 | Masinelli | 102/516 |
| 2012/0124879 | A1 | | 5/2012 | Larue | |
| 2012/0227615 | A1 | | 9/2012 | Beal | |
| 2013/0014664 | A1 | | 1/2013 | Padgett | |
| 2013/0014668 | A1 | | 1/2013 | Emary | |
| 2013/0025490 | A1 | * | 1/2013 | Burczynski | 102/439 |
| 2013/0086834 | A1 | | 4/2013 | Battaglia | |
| 2013/0305950 | A1 | | 11/2013 | Coffman, II | |
| 2014/0261044 | A1 | | 9/2014 | Seecamp | |
| 2014/0311372 | A1 | * | 10/2014 | Burczynski et al. | 102/508 |
| 2014/0331885 | A1 | * | 11/2014 | Burczynski | 102/439 |

FOREIGN PATENT DOCUMENTS

| | | | |
|---|---|---|---|
| DE | 743914 | C | 1/1944 |
| DE | 1072515 | | 12/1959 |
| DE | 2064553 | A1 | 7/1972 |
| EP | 0225532 | A1 | 6/1987 |
| EP | 0918208 | A1 | 5/1999 |
| GB | 191300326 | A | 1/1914 |
| WO | WO 2014186007 | A1 * | 11/2014 |

OTHER PUBLICATIONS

Written Opinion dated Oct. 7, 2014 for PCT/US2014/015672 filed Feb. 11, 2014.

* cited by examiner

REDUCED FRICTION EXPANDING BULLET WITH IMPROVED CORE RETENTION FEATURE AND METHOD OF MANUFACTURING THE BULLET

BACKGROUND 1.0 Field of the Disclosure

This disclosure relates generally to ammunition, and more specifically, to a reduced friction expanding bullet with improved core retention and a method of manufacturing the same.

2.0 Related Art

For a bullet to achieve optimum terminal performance, it is desirable that its jacket and core penetrate a target as a single unit and remain connected throughout the course of travel, regardless of the resistance offered by the target material.

Various attempts thus have been made over the years to form bullets wherein the bullet's jacket and core remain coupled together on impact. One of the earliest and simplest attempts utilized a knurling method which created a "cannelure" in a jacketed bullet. A cannelure typically includes a narrow, 360° circumferential depression in the shank portion of the bullet jacket. While the cannelure was originally conceived for use as a crimping feature, various manufacturers have attempted to use it as both a crimping groove and as a core retaining feature, or solely as a core retaining feature. The knurling process typically utilizes a multi-tooth knurling wheel which cuts into the jacket and forces jacket material radially inwardly, subsequently creating a shallow internal protrusion which extends a short distance into the bullet core. As a result, the jacket wall often can be weakened circumferentially in both the fore and aft areas of the cannelure. The cannelure approach thus has been found to be ineffective in keeping the core and jacket together as upon impact with a hard barrier material, the core tends to immediately extrude beyond the confines of the shallow inner protrusion, subsequently sliding out of the jacket. Depending on jacket wall thickness, core hardness, and impact energy, axial core movement can actually "iron out" the internal geometry of the cannelure as the core slides forward. In addition, when impacting windshield glass, the jacket can crack and/or be severed circumferentially along the weakened boundaries of the cannelure. Such a failure can result in jacket-core separation and a concomitant loss in bullet mass and momentum, which reduces target penetration. Even multiple cannelures have proven ineffective in retaining the core, due to the inadequate amount of square area they are collectively able to cover.

For example, U.S. Pat. No. 4,336,756 (Schreiber) describes a bullet intended for hunting. The bullet comprises a cold-worked jacket utilizing a narrow, inwardly-extending section of integral jacket material terminating in a "knife-like edge" that is formed from a thickened portion of the jacket wall and engages and holds the base of the core within the jacket after the bullet is finally formed. U.S. Pat. No. 4,856,160 (Habbe, et al.) also describes a bullet that appears to utilize a reverse taper on the rearward interior of the jacket to lock the core within the jacket.

Other attempts at retaining the core within the jacket have been used in the past. Such attempts range from providing a "partition" separating a rear core from a front core, electroplating a copper skin around the core prior to final forming the bullet, and heat-bonding (or similar heat treatment) the core to the interior of the jacket wall after the bullet is finally formed. Shortcomings of these methods can include one or more of the following: Jacket-core eccentricity resulting in less than desirable accuracy due to bullet imbalance; slower manufacturing rates; high or increased costs; and/or lower reliability.

SUMMARY OF THE INVENTION

This disclosure relates generally to a low-cost, easily manufactured expanding bullet having a malleable core inside a jacket formed from a malleable material with a hardness greater than that of the core, and which includes a core-retaining feature comprising a portion of the jacket wall. The present disclosure further relates to a method of making a low-cost, multi-component bullet having a swage-induced radiused area formed in a portion of the jacket wall, which radiused area forms a robust, inwardly projecting core-locking feature within the interior of the jacket. As a result, the core remains locked within the jacket even after impact with a hard barrier material such as windshield glass or sheet steel, for example. The radiused area further can provide a reduced bearing surface and reduced frictional resistance resulting in higher bullet velocity and formation of a living hinge in the radiused area to help expedite and facilitate uniform bullet expansion.

According to one aspect of the disclosure, the expanding bullet includes a malleable core having a first end and a second end, a jacket comprising malleable material surrounding the malleable core. The jacket further has a first or proximal end, a second or distal end, and a radiused circumferential depression is formed in the jacket. This radiused circumferential depression is configured to retain the malleable core within the jacket during use, with at least a portion of the inwardly protruding jacket wall correspondingly engaging and compressing or urging the core inwardly so as to form a mating circumferential depression or radiused area in the malleable core.

According to another aspect of the disclosure, a method for manufacturing a bullet, includes compacting a malleable core into a jacket to create a pre-form, which is urged into a die to form a transition shoulder therealong. The pre-form is then engaged with an axial force, causing a portion of the jacket wall to collapse inwardly, adjacent the transition shoulder portion, thus forming an indentation about the circumference of a jacket, and further forming a corresponding indention about a circumference of a malleable core within the jacket such that the jacket and malleable core are retained together during impact with even hard barrier materials at a desired velocity.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the invention, are incorporated in and constitute a part of this specification, illustrate embodiments of the invention, and together with the detailed description, serve to explain the principles of the invention. No attempt is made to show structural details of the invention in more detail than may be necessary for a fundamental understanding of the invention and the various ways in which it may be practiced. FIGS. 1-10 are each longitudinal cross-sectional views. In the drawings:

FIG. 1 is an exemplary illustration of an empty cylindrical metal jacket, configured according to an embodiment of the invention;

FIG. 2 is an exemplary illustration showing a malleable core placed into the cylindrical jacket shown in FIG. 1;

FIG. 3 is an exemplary illustration showing the cylindrical jacket and core of FIG. 2 engaged by a seating punch for seating the core within the jacket;

FIG. 4 is an exemplary illustration showing a configuration of the jacket-core assembly of FIG. 3 after engagement by the seating punch and with the jacket-core assembly forced into a die to produce a generally bottleneck-shaped "pre-form" configuration;

FIG. 5 is an exemplary illustration showing the pre-form of FIG. 4 after the pre-form has been engaged by a nose-cut die to configure jacket-weakening features in the jacket;

FIG. 6 is an exemplary illustration showing a final profiled bullet with the core-locking feature upon engagement of the nose-cut pre-form of FIG. 5 within a hollow point profile die;

FIG. 8 is a cross-sectional view of a cartridge case containing a finished bullet, showing a diameter of the bullet ogive with respect to a diameter of the bullet's shank;

FIG. 9 is a cross-sectional view of a "soft point" variant of the finished bullet that does not contain a hollow point cavity in its nose;

FIG. 10 is a cross-sectional view of a pointed soft point rifle bullet that does not contain a hollow point cavity in its nose.

DETAILED DESCRIPTION OF THE DISCLOSURE

Figure 3:
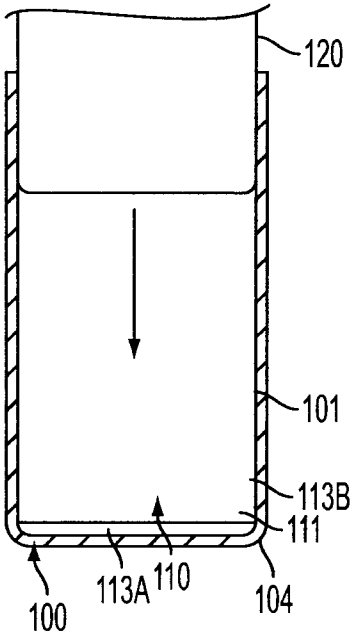

The embodiments of the invention and the various features thereof are explained in detail with reference to the non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

It is understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this invention belongs. Preferred methods, devices, and materials are described, although any methods and materials similar or equivalent to those described herein can be used in the practice or testing of the invention.

The disclosure is generally directed to an expanding bullet including a metal jacket and a malleable core and having a reduced friction contour or configuration and an improved core retention feature formed therein. Swaging a pre-form of the bullet in a profile die forms an inwardly projecting radiused area or circumferential protrusion on the interior wall of the jacket which embeds itself in the malleable core. This radiused area or circumferential protrusion provides a core retention or locking feature that generally locks/retains the core within the jacket without weakening the jacket. This core-retention or locking feature essentially comprises a wide-area radius which also serves as a living hinge to help expedite and/or promote uniform bullet expansion. The jacket and core accordingly are retained and/or remain locked together even after the bullet is fired from a firearm and impacts hard barrier materials such as windshield glass, sheet steel or the like, so as to retain a large percentage of the original weight of the bullet while also enabling a controlled or desired expansion of the bullet on impact. The present bullet with its core retention feature is adapted to achieve a post-barrier penetration of ballistic gelatin that exceeds 12 inches—the minimum depth called for in the FBI's Ballistic Test Protocol. In so doing, the bullet exhibits a terminally effective degree of expansion beyond its original diameter.

Figure 6:
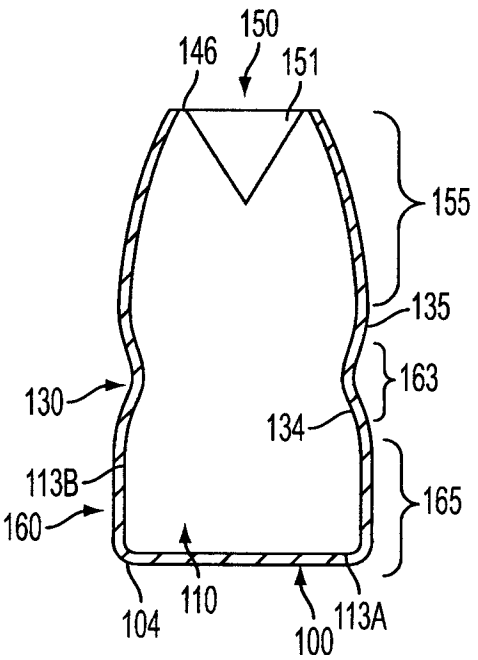
Figures 7A, 7B, 7C, 7D:
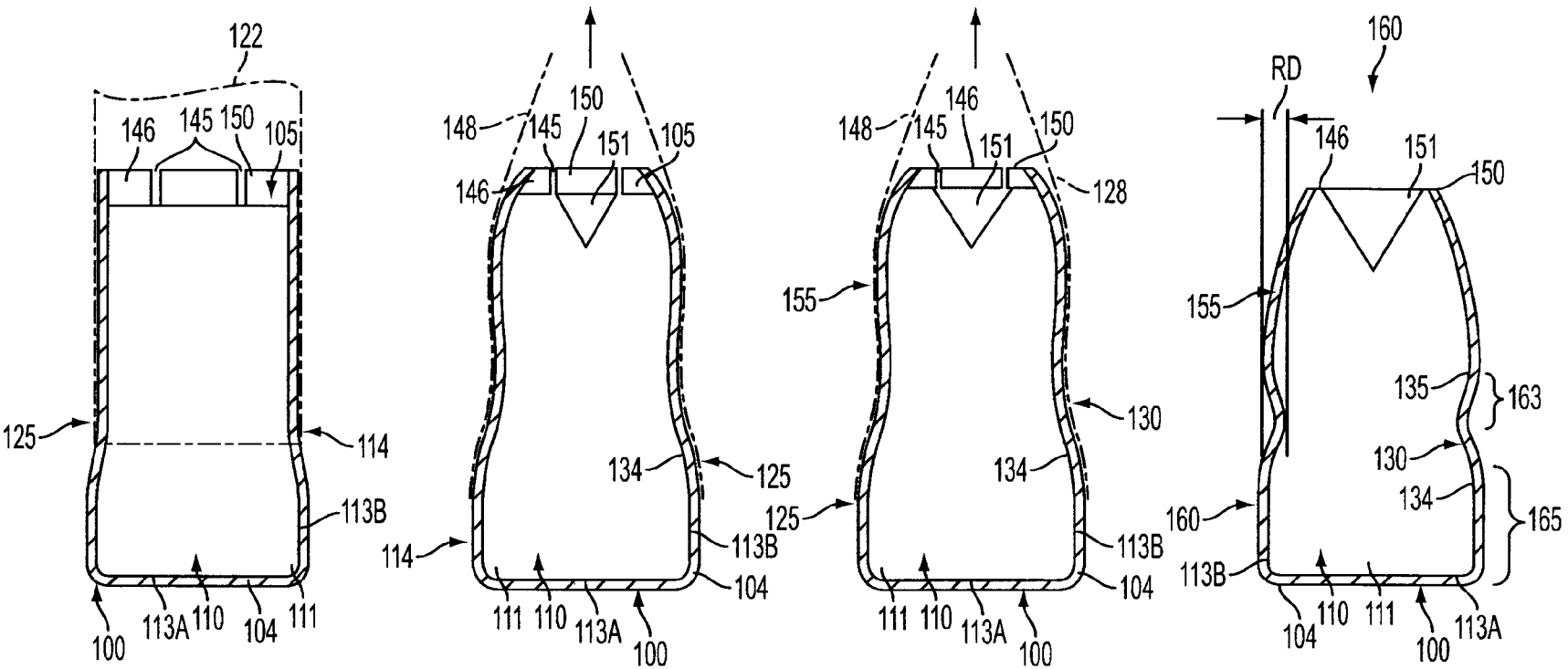
FIGS. 7*a*-7*d* illustrate the changing shape of the nose-cut pre-form of FIG. 5 to form the final profiled bullet of FIG. 6.
Figure 8:
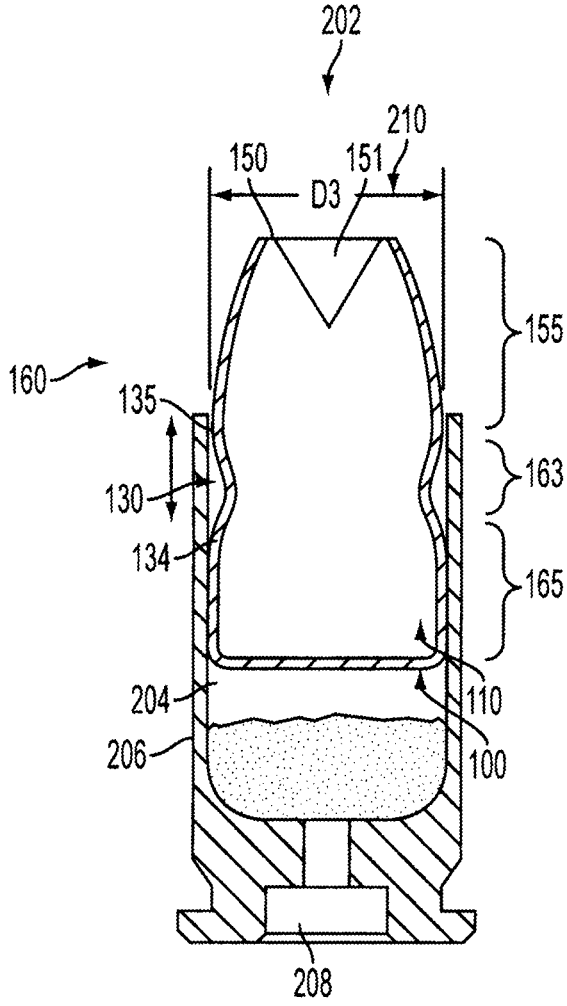
Figure 9:
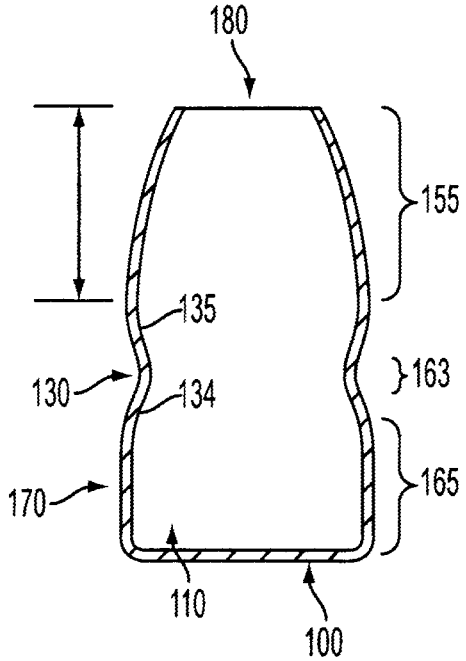
Figure 10:
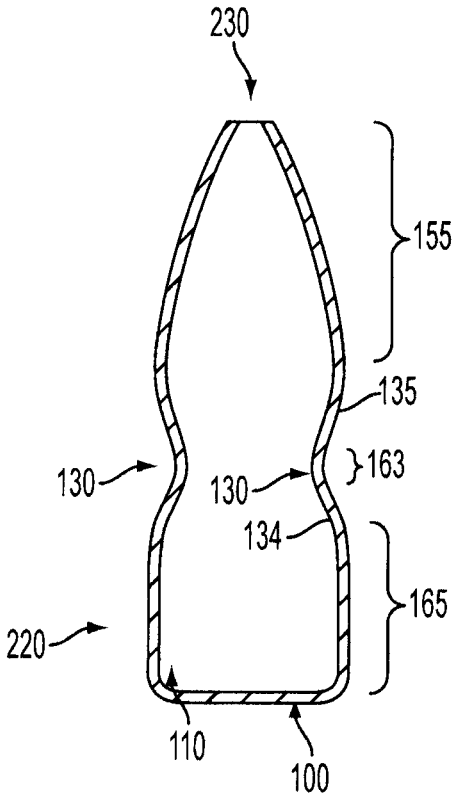

FIGS. 1-7*d* generally illustrate one example method of forming a bullet 160 with an improved core retention feature 130 according to the principles of the present invention, examples of which are illustrated in FIGS. 6 and 8-10. In particular, FIGS. 1-6 herein may be viewed as an overall sequence describing a first exemplary process performed according to the embodiments of the invention for manufacturing a two-component bullet. The resulting two-component bullet is configured according to principles of the disclosure. FIGS. 7*a*-7*d* show the contouring/shaping of the bullet to a final form, while FIGS. 8-10 show various example embodiments of the bullet. As shown in FIGS. 6 and 8-10, the bullet 160 generally includes a jacket 100 having a core 110 received therein, and with the jacket and core undergoing formation and contouring operations, as generally illustrated in FIGS. 1-7*d*, to form the core retention feature, generally illustrated as a radiused circumferential depression or area cooperatively/matingly formed in both the jacket and core.

Figure 1:
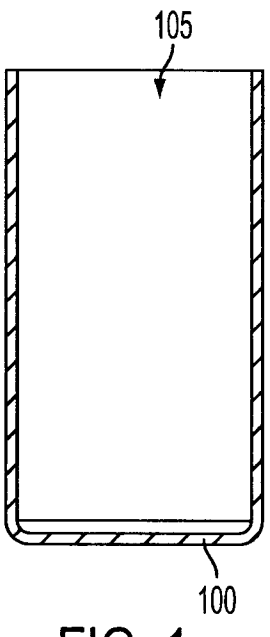

FIG. 1 illustrates an empty cylindrical metal jacket, generally denoted by reference numeral 100. The cylindrical metal jacket 100 may be drawn from a metal cup and trimmed to an appropriate length, and has an open end 105. The jacket 100 may be made from any suitable malleable material. Preferred materials can include brass, gilding metal, copper and mild steel. The jacket 100 may be configured in size based on any intended caliber, such as .223, .243, .308, 9 mm, .357, .38, .40, .44, or .45, for example only. However, nearly any caliber bullet may be produced using the embodiments of the invention.

Figure 2:
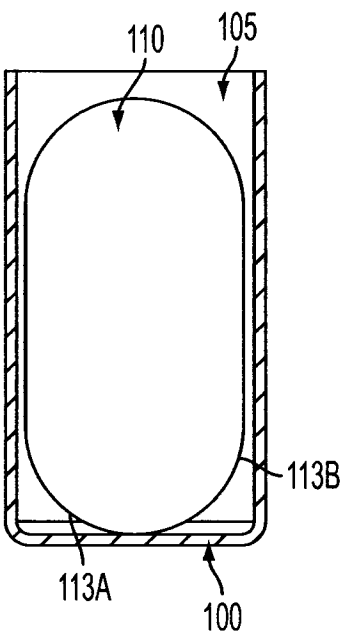

As shown in FIG. 2, in a first step, a malleable core 110 will be placed or dropped into the cylindrical jacket 100 shown in FIG. 1. At this point, the malleable core 110 generally is loose within the jacket 100. The malleable core 110 further may be made from any suitable core material, such as pure lead and alloyed lead containing a percentage of antimony, although other materials also are contemplated. The core further generally will have a hardness less than that of the jacket 100 so as to be compressible or flowable within the jacket as needed.

Figure 4:
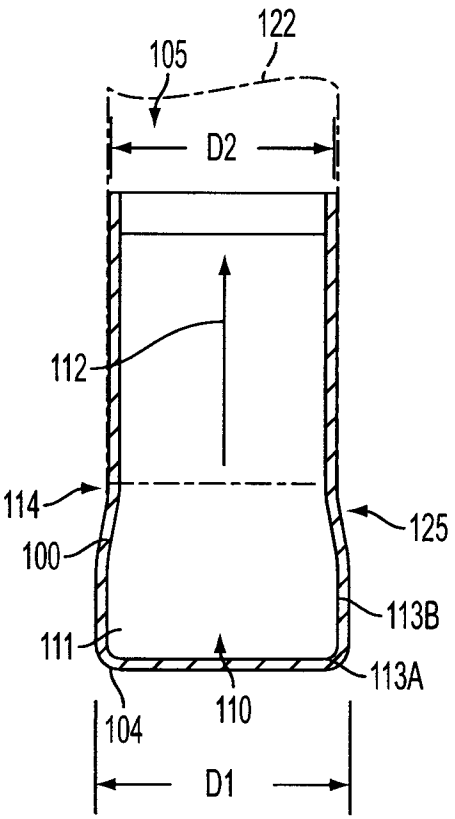

As shown in FIG. 3, the cylindrical jacket 100 and core 110 of FIG. 2 will be engaged by a seating punch 120 to forcefully seat the core 110 within the jacket 100. This may be accomplished if the jacket 100 and core 110 are held in a fixture such as a substantially cylindrical die (not shown). As FIG. 3 indicates, this application of a seating force generally can cause the core to shorten axially and expand radially, creating a wider base end 111 (FIG. 4). At this juncture, bottom and side surfaces 113A and 113B of the core 110 are urged into intimate contact with the interior wall 101 of the jacket 100. The jacket 100 and core 110 thus are securely coupled together, forming a two-piece jacket-core assembly for the balance of the manufacturing steps.

After seating of the core 110 within the cylindrical jacket 100 as shown in FIG. 3, and after the seating punch 120 has fully retracted, the jacket-core assembly then can be urged or forced into a bottleneck-shaped die, indicated in phantom lines 122 in FIG. 4. This produces a bottleneck-shaped configuration, hereafter, a "pre-form" 114, as shown in FIG. 4, with an enlarged bottom or base end 104 and an open-mouthed front end 105. The open-mouthed front end 105 of the pre-form 114 generally will be constricted inwardly along a length of the jacket 100, resulting in a smaller diameter D2 at the open end 105 than the diameter D1 of its closed, base end 104. For example, the diameter D2 of the open end 105 can vary in size with respect to the diameter D1 of the base 104 by a ratio of approximately 0.6 to 1.0 to about 0.8 to 1.0, depending on bullet caliber.

The opposite ends of the pre-form are connected by a transition angle which forms a tapered shoulder 125 along the body of the jacket 100. It also should be noted, however, that in lieu of a transition angle, the ends of the pre-form can be connected by a radius, or generally curved transition area. As indicated in FIG. 4, during the constriction process, the core 110 is proportionally constricted with the jacket 100 as it is forced to assume the substantially bottleneck-shaped geometry of the interior of the jacket wall. The subsequent volume reduction of the upper portion of the core also generally forces the malleable core 110 to flow forward within the jacket, as represented by arrow 112, growing in length towards the open end 105 of the pre-form 114. The constriction action further tightens the engagement of the seated core 110 within the jacket 100. Moreover, the tapered shoulder 125 further acts to lock/retain the now expanded and re-formed core 110 in-place proximate the base 104 of the jacket 100. During this process the pre-form 114 also may be inverted, i.e., rotated 180°, although it should be noted that the manufacture may be completed with any orientation.

Figure 5:
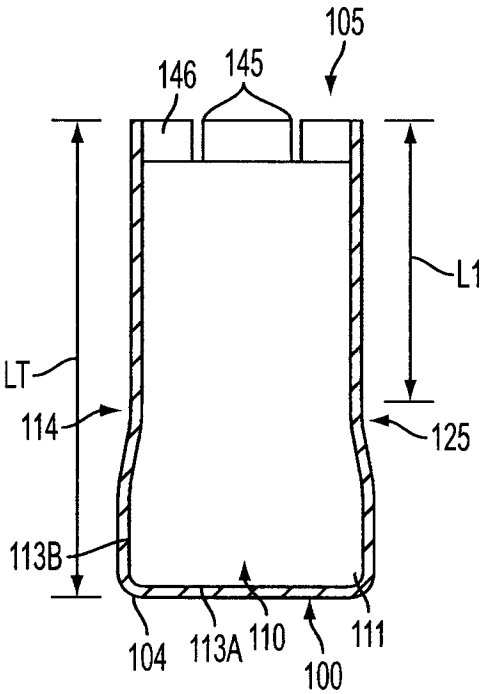

FIG. 5 is an exemplary illustration showing the pre-form 114 of FIG. 4, configuration of a series of jacket-weakening features 145 in the jacket 100, such as by engagement of the pre-form in a nose-cut die (not shown). It should be understood, however, that various jacket weakening features 145 may be applied to the jacket mouth 105 at this station, which may include axially spaced slits, slanted slits, V-shaped notches, axial scores, and the like (or combinations thereof) in the jacket mouth 105. While a finished bullet may be made without jacket-weakening features 145, it can be desirable to include at least the type of jacket weakening features 145 to help ensure consistent and reliable expansion over a wide range of velocities in various mediums. Upon impact, such jacket weakening features 145 may cause the bullet to form spaced petals during expansion.

Moreover, in one aspect, the jacket weakening features 145 may comprise a plurality of longitudinally projecting spaced slits 145 forming spaced petals therebetween and having side edges 146 (FIGS. 7*a*-7*c*) that generally will be folded over so as to extend through a front open end of the malleable core into a central recess 151 formed in the core at the nose end 150 of the bullet to form petals of core material and jacket material between the spaced slits. This also can permit the petals of core and jacket material to separate and form outwardly projecting petals.

FIG. 6 is an exemplary illustration showing a final form of the bullet 160, after the pre-form 114 has been progressively shaped or contoured into the final bullet configuration as shown in FIGS. 7*a*-7*d*. For example, the pre-form 114 can be swaged and/or forced or axially compressed into one or more profile dies (shown in phantom lines 148 in FIGS. 7*b*-7*c*), subsequently forming the finished bullet. The final form of the bullet 160 may or may not have a hollow point or central recess 151 in its nose 150, depending on desired features, and other nose features are possible. Regardless of its final nose configuration, the circumferential indentation or core retention feature 130 (i.e., a wide-area, inwardly-curving radiused groove) extends into and thus mates the jacket and core so as to retain the core 110 within the jacket 100 whether the bullet 160 impacts a hard barrier material such as windshield glass or metal, or a soft target, at a desired velocity, e.g., high velocity.

FIGS. 7*a*-7*d* are exemplary illustrations showing the changing shape of the pre-form 114 of FIG. 5 after it has been transferred to a profiled swaging die 148 and as it is being subjected to increasing swaging pressure and axial jacket collapse inside the profile die to form the core retention feature/indentation 130. It should be understood that the pre-form 114 can undergo a substantially infinite number of minute changes in shape while inside the profile die as swaging pressure rises. With this in mind, FIG. 7*a* shows the pre-form 114 of FIG. 5, prior to swaging. As indicated in FIGS. 5 and 7*a*, in an initial state, the upper end 114*a* of the pre-form 114 generally can be of a length of about 40% up to about 70% of the total bullet length prior to swaging. For example, for pistol bullets the length of the upper end 114*a* can range from about 40%-60% of the total bullet length LT, while for rifle bullets, it can range between about 50%-70% of total bullet length LT.

As indicated in FIGS. 6 and 7*a*-7*d*, the circumferential indentation 130, which defines the core retention feature is formed as a portion of the jacket collapses axially within the profile die and is forced or directed radially inwardly, forming the radially inward projecting area or indentation 130 bounded by a lower edge portion 134 and an upper edge or undercut (coved) area 135, each of which generally have a larger diameter than the inward projecting area 133. As shown in FIGS. 6, 7*d* and 8, the circumferential indentation 130 generally will be formed as a wide area radiused depression located rearward of the greatest width/diameter D3 (FIG. 8) of the ogive 155 of the bullet, so as to define a "living hinge" 163 along the bullet 160. This living hinge area facilitates flexing and bending of portions of the ogive, such as created by the petals 146, as the ogive impacts a target and expands. This can accordingly reduce the work involved in expanding the bullet to a desired and/or necessary amount and can facilitate or expedite the rate of bullet expansion on impact at any given velocity level without weakening the jacket 100 or fostering separation between the jacket and core. From a terminal ballistic standpoint, the living hinge 163 aspect of the bullet also can allow bullets fired from inherently lower velocity cartridges to expand easier by utilizing the undercut (coved) area 135 of the circumferential indentation 130 as a pivot or expansion point. The coved/hinge area allows the petals of the expanding ogive to fold outwardly and rearwardly on impact while encountering the reduced resistance.

While the circumferential indentation 130 is shown as being located just rearward of the greatest width of the ogive 155, the circumferential indentation 130 also can be positioned along any portion of the shank 165 or bearing surface of the bullet. However, the circumferential indentation 130 can be located at varying locations along the shank 165 of the bullet wherein the living hinge aspect or area of the invention preferably is maintained. As a result, the shape and/or internal geometry derived from the use of a wide-area, externally situated radius of the circumferential indentation helps foster superior bullet core retention ability during impact, while also facilitating a desired, controlled terminally effective expansion of the jacket and core, as compared with prior art bullets. Additionally, the wide-area radiused shape of the circumferential indentation further can reduce the bullet's bearing surface, which in turn can help reduce in-bore friction when the bullet is fired from a firearm.

FIGS. 7*b*-7*c* illustrate two incrementally progressive shape changes of the pre-form 114 which can occur while inside the profile die (indicated by phantom lines 148 in FIGS. 7*b* and 7*c*), and FIG. 7*d* represents a finished bullet 160 after being subjected to maximum swaging pressure. More specifically, FIG. 7*b* shows the nose-cut pre-form 114 after it has been swaged or forced into the profile die a short distance, FIG. 7*c* shown the nose-cut pre-form 114 after it has been forced further into the profile die, ending in the finished bullet 160 shown in FIGS. 6 and 7*d*. It should be understood that the pre-form shapes illustrated in FIGS. 7*b* and 7*c* are not necessarily distinct manufacturing steps associated with the invention disclosed, but merely represent progressive shape changes that can occur in the final step inside the profile die, and indicate how the externally located wide-area radius is progressively formed as the jacket and core collapse inwardly as the length of the upper end 114*a* (forming the ogive 155) is reduced to about 30-60% for pistol bullets and about 50-80% for rifle bullets.

The axial length and the radial depth of the circumferential indentation formed in the outside surface of the axial compression of the core by the interior wall of the jacket coalesce to provide superior core-locking ability. In one example embodiment, the circumferential indentation 130 may be constructed to have a radial depth RD (FIG. 7*d*) of between about 0.020 of an inch and about 0.080 of an inch, with an axial wall height of between about 0.050 of an inch and about 0.300 of an inch. A preferred height generally can be between about 0.075 of an inch and about 0.200 of an inch for pistol bullets and between about 0.100 and about 0.250 of an inch for rifle bullets. The jacket 100 may be constructed to have a wall thickness of between about 0.009 of an inch and about 0.040 of an inch, for example, generally having between about 0.012 of an inch and about 0.020 of an inch for pistol bullets and between about 0.020 of an inch and about 0.035 of an inch for rifle bullets, although greater or lesser thicknesses also can be used.

FIG. 8 is a view of a cartridge including the bullet of FIG. 6. In particular, as shown in FIG. 8, a round of ammunition 202 (i.e. a cartridge) for use in a firearm may be produced by employing the bullet 160 configured and produced according to the principles of the disclosure herein. The bullet 160 may be combined with a casing 204 of appropriate length, propellant 206, and primer 208, for example, to produce a round of ammunition. The length of the casing may expose, partially cover, or fully cover the circumferential indentation 130. For example, the widest point of the outside diameter D3 of the ogive portion 155 can be located at approximately the mouth 205 of the cartridge casing 204, with the wider diameter base end of the bullet engaging the walls of the casing to locate the bullet at a desired position therealong.

FIG. 8 further shows a finished/contoured profile of the bullet 160 wherein the widest diameter of the bullet ogive 155 (designated at "D3" by arrows at 210) is smaller than the diameter of the shank 165 (i.e., the diameter of the base portion 111 thereof). It should be understood that in the illustrated profile, the shank 165 diameter is preferably at or approximately equivalent to the firearm barrel's "groove diameter" and the diameter of the ogive at its greatest width is preferably at or about the firearm barrel's "bore diameter." This diameter arrangement can help provide an additional reduction in in-bore friction as the bullet moves along the barrel bore, resulting in still higher muzzle velocities. The increase in velocity provided by reduced ogive diameter D3 is in addition to higher muzzle velocities that can be afforded by the reduced bearing surface of the circumferential indentation 130. Additionally, the diameter of the ogive 155 can be substantially the same diameter as the shank if desired. In this regard, matching the two diameters can be accomplished by simply increasing swaging or axial compression pressure within the profile die during the swaging operation.

FIG. 9 is an exemplary illustration of a bullet 170 which is a variant of the bullet shown in FIGS. 6 and 8. The bullet 170 shown in FIG. 9 is similar to the bullet shown in FIG. 6 except that the nose 180 of the bullet 170 terminates in a solid or "soft point" configuration which does not include a hollow point cavity. Like the bullet of FIG. 6, this bullet 170 utilizes the circumferential indentation 130 and is formed after the pre-form shown in FIG. 5 is transferred to a profile die and swaged using substantial swaging pressure. The soft point bullet 170 is useful where a slower rate of bullet expansion and deeper target penetration is desired.

FIG. 10 shows another aspect of the bullet. This aspect shows a bullet 220 with a more pointed, more streamlined ogive 155 shape than that shown in the previous illustrations herein. The ogive 155 in FIG. 10 is more in keeping with a bullet that would be fired from a rifle versus a pistol and has a higher ballistic coefficient and would produce a flatter trajectory. Although this bullet is shown in soft point form, the nose can contain either a hollow point or an embedded polymer tip of the type found in popular rifle bullets currently being marketed. It should be noted that a rifle bullet 220 is made using the same basic steps as those shown in FIGS. 1-6.

It should be understood that, regardless of its intended use or the firearm from which it is fired, the bullet as disclosed herein may have any forward profile or any nose type. Any forward profile or nose type can be used. The front portion of the bullet can be ogival (as shown in the illustrations herein), conical, frusto-conical, spherical or cylindrical (the latter terminating in a flat at the nose). By the same token, the rear profile of the bullet can be of any shape desired. The rear profile does not have to be flat as shown in the illustrations herein. As an alternative, the base of the bullet may terminate in a "boat tail" shape if desired.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. An expanding multi-component bullet comprising:

a malleable metal core having a first end and a second end;

a metal jacket surrounding the malleable core, the jacket having a wall, a first end defining an ogive portion therealong, and a second end; and a core retention feature formed along a shank portion of the jacket adjacent the ogive portion and configured to retain the malleable core within the jacket upon impact and expansion of the core and jacket, the core retention feature comprising an axially collapsed circumferential depression extending into the wall of the jacket and forming a mating circumferential depression in the malleable core, wherein the circumferential depression defines a hinge area located rearward of the ogive portion and configured to facilitate flexing of the ogive portion to foster expansion of the jacket and malleable core upon impact of the bullet.

2. The expanding multi-component bullet of claim 1, wherein the hinge area defined by the circumferential depression in the wall of the jacket comprises a radiused groove having upper and lower edges and a radially inward projecting center area having a diameter less than a diameter of each of the upper and lower edges, and wherein an axial wall height of the groove is between about 0.075 of an inch and about 0.300 of an inch.

3. The expanding multi-component bullet of claim 2, wherein the upper edge of the radiused groove defines a living hinge area about which the jacket and core undergo expansion on impact with a target.

4. The expanding multi-component bullet of claim 1, wherein the first end of the jacket comprises a bullet tip and the second end of the jacket comprises a bullet base, and wherein the bullet base is closed.

5. The expanding multi-component bullet of claim 1, wherein a maximum outside diameter of the ogive portion of the jacket is less than an outside diameter of the second end of the jacket.

6. The expanding multi-component bullet of claim 1, wherein an outside diameter of the ogive portion of the jacket is substantially the same as an outside diameter of the second end of the jacket.

7. The expanding multi-component bullet of claim 1, wherein the malleable core has a central recess defined in the first end of the core.

8. The expanding multi-component bullet of claim 1, further comprising jacket weakening features configured in the first end of the jacket.

9. The expanding multi-component bullet of claim 8, wherein the jacket weakening features comprise a plurality of longitudinally projecting spaced slits forming spaced petals.

10. The expanding multi-component bullet of claim 1, wherein the jacket comprises a coved area forming a transition from a widest diameter of the ogive portion to the circumferential depression.

11. The expanding multi-component bullet of claim 1, wherein circumferential depression comprises a wide-area, inwardly-curving radiused groove bounded by at least one sloped or radiused edge.

12. A method for forming a bullet adapted to expand on impact, comprising:

positioning a malleable core within a surrounding jacket;

axially collapsing the jacket along a portion thereof so as to form a radially inwardly projecting circumferential indentation; and as the jacket is collapsed axially and inwardly, engaging the malleable core with the portion of the jacket forming the circumferential indentation so as to form a corresponding circumferential indentation within the malleable core;

wherein the corresponding circumferential indentation of the malleable core is mated within the circumferential indentation of the jacket such that the jacket and malleable core are retained together during expansion of the malleable core and jacket upon impact at a desired velocity, and defines a hinge portion along a bearing surface of the bullet to facilitate expansion of the ogive portion upon impact.

13. The method of claim 12, wherein the inwardly projecting circumferential indentation of the jacket is formed between an upper edge and a lower edge each having a diameter greater than a diameter of the circumferential indentation, to assist in locking the core to the jacket.

14. The method of claim 13, further comprising:

(a) compressing the malleable core within the jacket to form a two-piece jacket-core assembly and;

(b) urging the jacket-core assembly into a bottleneck-shaped die to produce a pre-form; and (c) urging the pre-form into a profiled swaging die for axially collapsing the jacket and forcing the portion of the jacket radially inwardly to form the circumferential indentation therein.

15. The method of claim 14, further comprising forming petals in a first end of the jacket and the core.

16. The method of claim 15, wherein forming petals in a first end of the jacket and core comprises engaging the pre-form with a nose-cut die and creating jacket-weakening features in the mouth of the jacket.

17. A cartridge comprising the bullet produced by the method of claim 16.

18. The method of claim 12, wherein the axially collapsing of the jacket forms the ogive portion of the bullet and a coved transition area between a widest diameter of the ogive portion and the circumferential indentation of the jacket, defining the hinge portion.

19. The method of claim 12, wherein the circumferential indentation comprises a wide-area, inwardly-curving radiused groove bounded by at least one sloped or radiused edge.

* * * * *